US005529145A

United States Patent [19]

Allred

[11] Patent Number: 5,529,145

[45] Date of Patent: Jun. 25, 1996

[54] SAFETY LADDER ATTACHMENT

[76] Inventor: Franklin Allred, 2434 Wicker Lovell Rd., Randleman, N.C. 27317

[21] Appl. No.: 255,401

[22] Filed: Jun. 8, 1994

[51] Int. Cl.[6] ..... E06C 7/00

[52] U.S. Cl. ..... 182/107; 182/206

[58] Field of Search ..... 182/107, 187, 182/214, 9, 129, 206; 248/499

[56] References Cited

U.S. PATENT DOCUMENTS

| | | | |
|---|---|---|---|
| 1,961,289 | 6/1934 | Gardner . | |
| 1,994,369 | 3/1935 | Risser . | |
| 2,908,522 | 10/1959 | Glave | 248/499 |
| 2,963,104 | 12/1960 | Roth . | |
| 3,001,603 | 9/1961 | Kraus . | |
| 3,037,579 | 6/1962 | Barrow . | |
| 3,630,314 | 12/1971 | Bamburg . | |
| 3,780,829 | 12/1973 | Wallingford . | |
| 3,792,756 | 2/1974 | Kelly . | |
| 3,828,889 | 8/1974 | Rehm . | |
| 4,090,587 | 5/1978 | Pyle . | |
| 4,545,460 | 10/1985 | Byrd . | |
| 4,714,136 | 12/1987 | Morin . | |
| 4,768,619 | 9/1988 | Darnell | 182/129 |
| 4,792,016 | 12/1988 | Ingalsbe . | |
| 4,880,079 | 11/1989 | Leclerc | 182/107 |
| 4,924,971 | 5/1990 | Rice . | |
| 4,946,004 | 8/1990 | Henson . | |
| 4,995,476 | 2/1991 | Buck . | |
| 5,016,732 | 5/1991 | Dunn . | |
| 5,054,581 | 10/1991 | Henson . | |
| 5,064,020 | 11/1991 | Eagleson | 182/187 X |
| 5,067,588 | 11/1991 | Bendickson . | |
| 5,332,063 | 7/1994 | Amacker | 182/116 |

FOREIGN PATENT DOCUMENTS

| | | | |
|---|---|---|---|
| 1717158 | 3/1992 | U.S.S.R. | 182/9 |

*Primary Examiner*—Alvin C. Chin-Shue
*Attorney, Agent, or Firm*—Rhodes, Coats & Bennett

[57] ABSTRACT

A safety ladder attachment for securing a ladder to an overhead, horizontal cable is described comprising a hollow, woven rope terminating at one end in an elastic loop formed of the rope in a compressed state and an elastic cord in the interior thereof, and terminating at the other end in a coupling member. The safety attachment is tied under tension with a slip knot about a rung of the ladder and the cable, and subsequently released from the ground by pulling on a release rope attached to the coupling member, which may also be a loop formed at the rope end.

9 Claims, 2 Drawing Sheets

SAFETY LADDER ATTACHMENT

BACKGROUND OF THE INVENTION

The present invention relates to a safety ladder attachment used to secure a ladder to an overhead cable, and specifically relates to a safety ladder attachment which can be released after the worker has safely reached the ground.

Utility repairmen and installers frequently need to brace their ladder against overhead cables. Since the cable does not provide a secure support for the ladder, there is a risk that the ladder may shift while in use, causing injury to the user. This risk is especially great when the user is ascending or descending the ladder.

Devices have been disclosed in the prior art for securing a ladder to an overhead cable. For example, U.S. Pat. No. 5,054,581 to Henson, describes a metal clamp which is secured across the upper two rungs of a ladder. The clamp includes a cable receiving slot with a locking mechanism. The user raises the upper end of the ladder adjacent the cable and slips the cable receiving slot over the cable to engage the locking mechanism. The user then must disengage the locking mechanism before descending the ladder.

U.S. Pat. Nos. 2,963,104 to Roth and 3,001,603 to Kraus, Jr., describe devices for securing a ladder to a plurality of overhead cables. These devices can be attached to two rungs of a ladder, and include a plurality of slots to receive cables. The device is lowered onto the cables when the ladder is positioned for use, and lifted from the cables to remove the ladder from the cables.

Devices of the above nature have several disadvantages. Since they are attached to the ladder, they are cumbersome, and make movement of the ladder more difficult. Also, they interfere with the use of the ladder for other purposes. Importantly, they do not provide secure attachment to a single cable, or they must be disengaged from a secure attachment while the user is still on the ladder.

Conversely, the safety ladder attachment described herein is easy to carry, is attached to the ladder only when there is a need to secure the ladder to an overhead cable, and holds the ladder securely to the cable until the user has safely descended. The safety attachment can then be readily released by the user.

SUMMARY OF THE INVENTION

The safety ladder attachment of the present invention includes a rope having opposed ends, with a loop of elastic material attached to one end of the rope, and a coupling member attached to the other end of said rope. Preferably, the safety ladder attachment has a braided or woven rope having an annular braided structure with a hollow interior, first and second opposed ends, and an intermediate segment between the ends, the first rope end being attached to the intermediate segment to form a first loop, and the second rope end being attached to the intermediate segment to form a second loop, and an elastic cord within the interior of the first loop. Typically, the first loop is from about 5 feet to about 7 feet in circumference, and the second loop is from about 0.5 to about 1.5 feet in circumference. The intermediate segment has a length of from about 2.5 to about 4.5 feet. The diameter of the rope is not critical, and will partly depend on the material used in its construction. The rope may, for example, have a diameter of about 5/16 inch. The diameter of the cord should be such as to fit snugly within the interior of the rope. With a woven hollow rope of 5/16 inch diameter, the cord will preferably have a diameter of about 3/8 inch.

The preferred safety attachment is formed from a length of hollow braided woven rope of about 15.5 feet in length by inserting an elastic cord, e.g., a bungee cord of about 6 feet in length, into one end of the interior of the rope. the cord is inserted so that about 3 inches of rope extends over the end of the cord at the end where it is inserted. The rope is compressed around the cord, permitting the cord to stretch to the length of the uncompressed rope. The end of the rope containing the cord is then formed into a loop of about 6 feet in circumference, and the end of the rope at the inserted end is attached to the segment of rope intermediate the elastic loop and the coupling member. This safety attachment may be achieved in any of a variety of ways, so long as the loop does not become disengaged under the forces incurred during subsequent use. A preferred way to attached the rope end is by clamping the intermediate rope segment and rope end with metal clips. These clips are then covered, e.g., with a heat shrink plastic wrap, to prevent them from snagging other objects.

The coupling member at the opposite end of the rope is used to connect the safety attachment of another rope for easy release, as will be described later. Preferably, the coupling member is formed by making another loop of about one foot in circumference at the coupling member end, and attaching the rope end to the intermediate segment of the rope. Preferably, the coupling member includes an indicator which will enable the user to readily distinguish the coupling member from other parts of the safety attachment. When a loop is used as the coupling member, the indicator may be a metal ring which is inserted over the rope segment forming the loop. Other indicators may be used. For example, the coupling member may be a different color, or coated with a plastic material.

A ladder is secured to a horizontal overhead cable by positioning an upper rung of the ladder adjacent the cable, wrapping the elastic loop under tension around the cable and rung and tying it with a slip knot. When the user is ready to descend the ladder, he attaches a release rope to the coupling member. After safely reaching the ground, the user pulls on the release rope to untie the slip knot and release the safety attachment from the rung and cable. A preferred slip knot is described in the description of the preferred embodiment. Formation of the slip knot will preferably include the step of inserting a folded section of rope through the elastic loop.

Use of the elastic loop permits the user to firmly secure the ladder rung to the cable, due to the tensioning of the loop. Also, the slip knot will be tight until the user pulls on the coupling member.

DESCRIPTION OF THE PREFERRED EMBODIMENT

Figures 1, 1A, 1B, 1C:
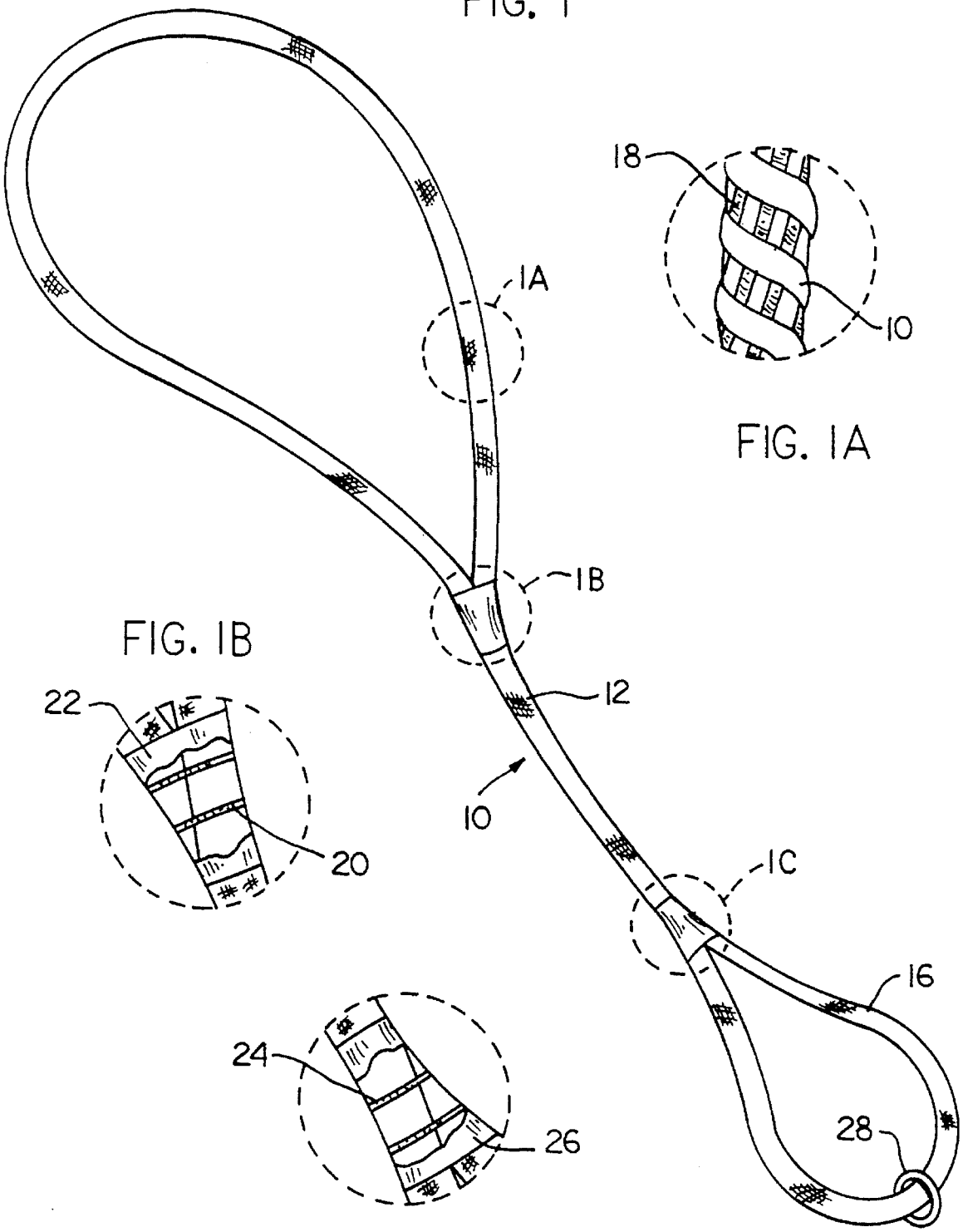
FIG. 1 is an illustration of the safety ladder attachment of the present invention, with circles identified as 1A, 1B and 1C.
FIGS. 1A, 1B and 1C are enlarged cutaway sections revealing interior elements of the respective circled portions 1A, 1B and 1C of FIG. 1.

As best shown if FIG. 1, the safety ladder attachment comprises a rope 10 having an intermediate segment 12, terminating in an elastic loop 14 at one end and a coupling member 16 at the other end. Segment 12, loop 14 and coupling member 16 are formed from a continuous length of rope 10, which is of a hollow, woven construction of nylon, polypropylene, or other suitable material. In the preferred embodiment, rope 10 is 5/16 inch in diameter in its relaxed state.

Elastic loop 14 comprises a segment of rope 10 in a compressed state, surrounding an elastic cord 18, which is inserted into the hollow interior of the rope. The rope weave is placed in a compressed state by pressing the weave in an axial direction for insertion of elastic cord 18. Cord 18 may be formed of rubber or other elastic material. One suitable available cord is known as a bungee cord. Cord 18 is 3/8 inch in diameter in the embodiment shown. Since rope 10 is in a compressed state around elastic cord 18, loop 14 can stretch when under tension until rope 10 reaches a tensioned state, i.e., until the fibers of rope 10 are more longitudinally aligned. Loop 14 will contract to its original size when no longer under tension.

Rope 10 is about 15.5 feet in length in its relaxed state, and elastic cord 18 is about 6 feet in length. In the complete safety attachment rope segment 12 is about 3.5 feet in length, elastic loop 14 is about 6 feet in circumference, and coupling member loop 16 is about 1 foot in circumference. Approximately six inches of rope are used to attach the rope ends to the rope to form the loops. Thus, the rope forming loop 14 is shortened by compression to approximately 4.5 feet. Since this compression occurs around elastic loop 14, it is apparent that rope 10 is compressed to about 60% of its relaxed length around cord 18. The exact degree of compression in not critical, so long as loop 14 is permitted to stretch during tying of a ladder to a cable. Normally, the compressed length of the rope segment comprising loop 14 will be from about 50 to 75% of the relaxed length of the rope.

Cord 18 is inserted into rope 10 so that about 3 inches of rope 10 extends past the end of the cord 18. The end of rope 10 containing cord 18 is then formed into a loop of about 6 feet in circumference, and the end of the rope is attached to rope segment 12 with metal clips 20. Clips 20 are then covered with heat shrink plastic wrap 22 to prevent clips 20 from snagging or catching on objects. Also, the plastic will inhibit corrosion of the metal clip.

Coupling member 16 is formed by making another loop in rope 10 at the coupling member end, and attaching the rope end to rope segment 14. The rope end is secured with clips 24 and heat shrink plastic wrap 26. Coupling member 16 includes indicator 28 to aid the user in readily distinguishing coupling member 16 from other parts of the safety attachment. Indicator 28, which is a metal ring, is slipped over the rope end before clamping with clips 24.

Figure 2:
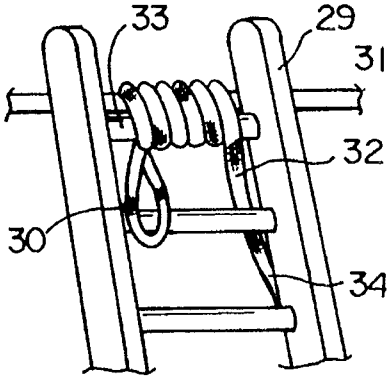

In order to secure a ladder 29 to an overhead cable 31 or other member, the user places an upper rung 33 of the ladder adjacent the overhead cable 31, and tightly wraps the loop 14 of the safety attachment under tension around the rung and cable as shown in FIG. 2, leaving a portion 30, which is about 10–12 inches of loop 14, hanging on one side of the wrapped section and a part 32 of rope section 12 on the other.

Figure 5:
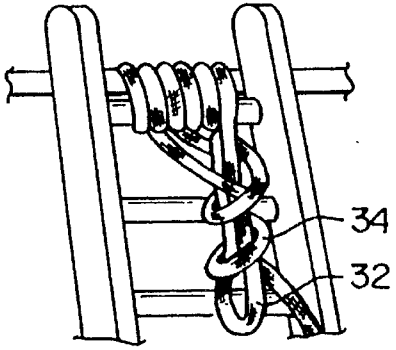
FIGS. 2–9 illustrate the steps in the formation of the preferred slip knot.
Figure 4:
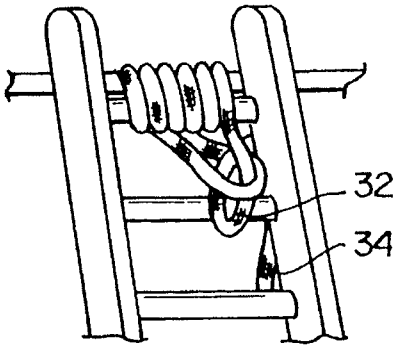
Figure 3:
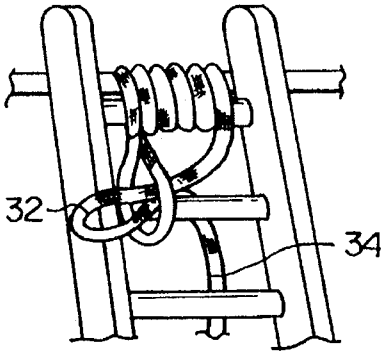
Figure 9:
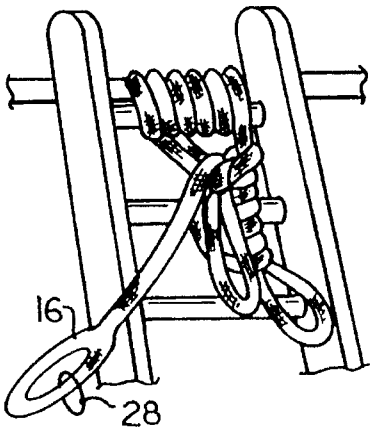
Figure 8:
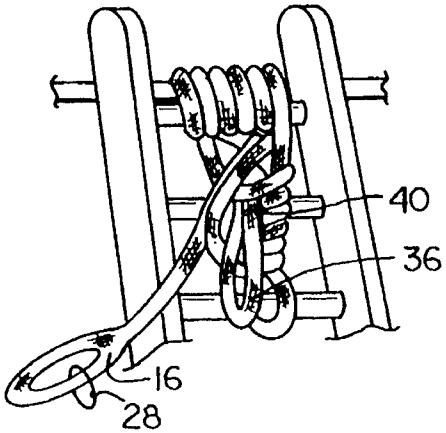
Figure 7:
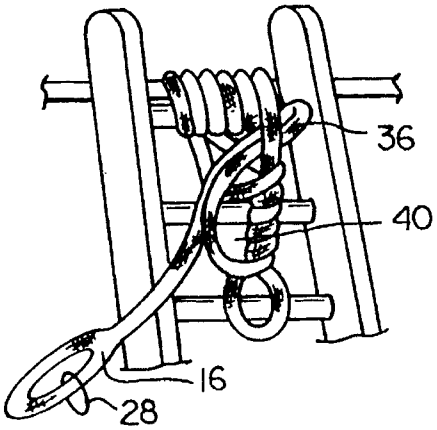
Figure 6:
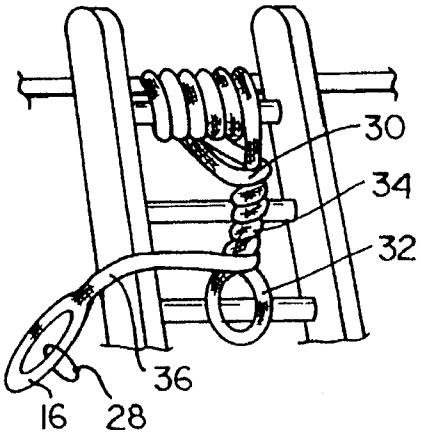

The part 32 of rope section 12 is then folded and inserted through portion 31, as shown in FIG. 3, and portion 30 is then moved close to the right ladder rung as shown in FIG. 4. A lower hanging part 34 is then wrapped around the folded part 32 that is projecting through portion 30 and tightened, as shown in FIGS. 5 and 6. A further part 36 of rope section 12 is again folded and wrapped around portion 30, and back through the opening 40 created, as shown in FIGS. 7 and 8, and the slip knot thus formed is pulled tight as shown in FIG. 9.

The ladder 29 is thus reliably secured to the cable or other member 31, and does not slip left or right. The worker on the ladder can carry out his or her task. When the task is complete, the ladder 29 can be quickly and easily disengaged from the cable 31 from the ground. The worker need only pull on the coupling member 16, which he or she can discern from the other loop by the presence of the indicator 28. The pulling can be by a further rope or a rod with a hook or other suitable arrangement, as desired.

Various modifications and improvements will occur to those skilled in the art upon a reading of the foregoing description. By way of example, the elastic loop can be separately formed, and then attached to the rope section. Also, different slip knots can be used to tie the safety attachment to the rung and cable. It should be understood that all such modifications and improvements have been deleted herein for the sake of conciseness and readability but are properly within the scope of the following claims.

What is claimed is:

1. A method of securing a ladder to an overhead support member comprising (a) providing a safety attachment comprising a rope having opposed ends, with an elastic loop attached to one of the ends, and a coupling member attached to the other of the ends;

(b) positioning an upper rung of the ladder adjacent a horizontal overhead support member;

(c) tying the safety attachment around the horizontal overhead support member and the rung with a slipknot; and (d) pulling on the coupling member to untie the knot and release the safety attachment from the rung and the horizontal overhead support member.

2. The method of claim 1, wherein the tying step comprises wrapping the rope and elastic loop around the horizontal overhead support member and rung and forming a slipknot with the rope and the elastic loop.

3. The method of claim 1, wherein the coupling member is a rope loop, and further comprising tying a release rope through the loop.

4. The method of claim 1, wherein the positioning step comprises positioning the upper rung adjacent a horizontal overhead support member which is a wire.

5. The method of claim 1, wherein the positioning step comprises positioning the upper rung adjacent a horizontal overhead support member which is a cable.

6. The method of claim 1 further comprising descending from the ladder prior to the pulling on the coupling member step, wherein the pulling step occurs from a ground position.

7. The method of claim 1, wherein the providing step comprises providing the elastic loop as a hollow braided rope with an elastic cord in the interior thereof, so that the elastic cord substantially prevents the elastic loop from becoming compressed when forming the slipknot, thereby preventing the slipknot from prematurely loosening while tied and forcing the elastic loop to an original form after the slipknot is untied.

8. The method of claim 7, wherein the tying step comprises wrapping the rope and the elastic loop, while under tension, around the horizontal overhead support member and rung and forming a slipknot with the rope and the elastic loop, whereby the slipknot includes a part of the elastic loop in a stretched condition to prevent the slipknot from prematurely loosening yet provide for easy release of the slipknot during the pulling step.

9. The method of claim 1 further comprising placing an identifier on the coupling member to provide easy identification of the coupling member.

* * * * *